United States Patent [19]

Hatch et al.

[11] Patent Number: 4,611,147

[45] Date of Patent: Sep. 9, 1986

[54] THERMIONIC GAS SWITCH

[75] Inventors: George L. Hatch, San Francisco; William A. Brummond, Livermore; Donald M. Barrus, San Jose, all of Calif.

[73] Assignee: The United States of America as represented by the United States Department of Energy, Washington, D.C.

[21] Appl. No.: 596,870

[22] Filed: Apr. 5, 1984

[51] Int. Cl.[4] ..... H01J 17/52; H01J 17/06

[52] U.S. Cl. ..... 313/550; 313/618; 313/310

[58] Field of Search ..... 313/618, 550, 310; 361/103, 161; 310/306; 376/321

[56] References Cited

U.S. PATENT DOCUMENTS

| | | | |
|---|---|---|---|
| 1,968,839 | 8/1934 | Lederer . | |
| 2,201,720 | 5/1940 | Elder . | |
| 2,586,291 | 2/1952 | Bender | 313/310 |
| 2,937,304 | 5/1960 | Goldberg et al. . | |
| 3,196,295 | 7/1965 | Oppen et al. | 313/310 X |
| 3,238,395 | 3/1966 | Sense | 310/306 |
| 3,250,943 | 5/1966 | Antonis et al. | 313/346 |
| 3,532,960 | 10/1970 | Shimada et al. | 376/321 X |
| 4,104,693 | 8/1978 | Toda et al. | 313/618 X |

OTHER PUBLICATIONS

"The Application of a Self-Actuating Shutdown System (SASS) to a Gas-Cooled Fast Reactor (GCFR)", by J. H. Germer et al., Report XL-895-00453, General Electric Co. Advanced Reactor Systems Department, Sunnyvale, Ca., Aug., 1981.

*Primary Examiner*—Palmer C. DeMeo
*Attorney, Agent, or Firm*—L. E. Carnahan; Roger S. Gaither; Judson R. Hightower

[57] ABSTRACT

A temperature responsive thermionic gas switch having folded electron emitting surfaces. An ionizable gas is located between the emitter and an interior surface of a collector, coaxial with the emitter. In response to the temperature exceeding a predetermined level, sufficient electrons are derived from the emitter to cause the gas in the gap between the emitter and collector to become ionized, whereby a very large increase in current in the gap occurs. Due to the folded emitter surface area of the switch, increasing the "on/off" current ratio and adjusting the "on" current capacity is accomplished.

20 Claims, 3 Drawing Figures

THERMIONIC GAS SWITCH

BACKGROUND OF THE INVENTION

The invention described herein arose under contract No. DE-AT03-76SF71032 between the United States Department of Energy and the General Electric Co.

The invention relates to temperature activated switches, particularly to temperature responsive thermionic switches, and more particularly to an improved thermally actuated thermionic gas switch.

Temperature responsive switches which involve a change of state condition or expansion of an operating material when temperature is applied thereto are well known in the art. Also, thermionic devices have been used for many years as lights, vacuum tubes, power converters, and as electrically driven switches. These prior thermionic devices use control grids, temperature difference between the emitter and collector, or voltage changes to cause their actions.

More recently, thermionic devices have been utilized in nuclear reactor control systems, particularly in self-actuated control systems responsive to low coolant flow, high coolant temperature, or over-power (high neutron flux) conditions of the reactor, wherein an above normal temperature condition is created. In such control systems, the control rods are rapidly inserted into the reactor core for quick shut down or "scram" of the reactor. Self-actuated reactor control systems which utilize thermally activated thermionic devices are described and claimed in copending U.S. patent applications Ser. No. 270,672 and Ser. No. 270,682, each filed June 4, 1981 in the name of D. M. Barrus et al, and assigned to the assignee of this application.

A thermally actuated thermionic switch, which constitutes an improvement over the thermionic devices illustrated in the above-referenced applications and which has particular application for use in reactor shutdown systems, is described and claimed in copending U.S. patent application Ser. No. 430,579 filed Sept. 30, 1982 in the name of D. M. Barrus et al, and assigned to the assignee of this application. In its operating condition this prior thermionic switch responds to an ambient temperature increase above a predetermined value by a change in its impedance from a high to a low value. To use that switch, a positive voltage is applied to the collector relative to the emitter. In its quiescent or "off" condition, this prior switch will allow a small current to flow through it determined by: (a) thermionic conditions of the switch, and (b) non-therminoic currents such as insulator surface conduction and low local voltage ignition currents. The thermionic conditions (a) are the ambient temperature, the cesium vapor density in the gap between the emitter and the collector, the surface area of the emitter, and the applied voltage level. The current resulting from these conditions is small and is the result of ionization near the collector. This ionization results from energetic electrons ionizing cesium atoms near the collector. A glow (called the anode glow) can be seen near the collector and is the result of electron-ion recombination. As the ambient temperature is increased the anode glow current increases until a critical level is reached and a very rapid acceleration in cesium atom ionization occurs completely neutralizing the space charge in the interelectrode gap. Ignition (ionization) occurs and the maximum current capacity of the switch is achieved for the level of the applied voltage.

The thermionic switch of the above-referenced copending application Ser. No. 430,579 has the following performance limitations:

1. Non-thermionic currents are higher than thermionic currents leading to a high "off" current, thus diminishing the "on/off" current ratio. "On/off" current ratios of only 10:1 have been attained.
2. The emission surface area remains constant in both switch current modes (on/off). Since it is desirable to have a small "off" current, it follows that the emission surface area must be small, thus limiting the "on" current.

While the thermal activated thermionic switch described and claimed in above-referenced application Ser. No. 430,579 is effective for its design purposes, there has been a need for increasing the "on/off" current ratio of thermionic gas switches.

Thus, an object of the present invention is to provide an improved thermally activated thermionic gas switch.

A further object of the invention is to provide a hollow cathode, thermionic gas switch responsive to temperature which has an increased "on/off" current ratio.

Another object of the invention is to provide a thermionic gas switch which employs folded emitter surface areas which effects the "on/off" ratio by changing the conduction surface areas involved in the on and off modes of the switch.

Another object of the invention is to provided a thermally activated thermionic gas switch, where in the "off" mode the conduction area is made small, while in the "on" mode the conduction area is made large.

Another object of the invention is to provide an improved temperature responsive thermionic gas switch utilizing a hollow-cathode and which utilizes a folded emitter surface area thereby increasing the "on/off" current ratio while providing for adjusting the "on" current capacity.

Other objects and advantages of the present invention will become apparent from the following description and accompanying drawings.

SUMMARY OF THE INVENTION

The above objects of the invention are carried out by an improved temperature responsive thermionic gas switch capable of increasing the "on/off" ratio to 450:1 and adjusting the "on" current capacity by employing a folded emitter surface area.

The folded emitter surface area of the improved thermionic switch effects the "on/off" ratio by changing the conduction surface areas involved in the two modes of the switch. In the "off" mode the conduction area is made small, while in the "on" mode the conduction area is made large. This is achievable by making the dimensions of the folds small enough so that a space charge will develop in the convolutions of the folds and suppress unignited current from the convolutions, thus limiting the current carrying surface in the ("off") mode to the equivalent projected area of the emitter surface. During ignition ("on" mode) the state of ionization permits space charge neutralization in the convolutions of the emitter surface increasing the current carrying surface area.

The improved thermionic gas switch utilizes a hollow cathode configuration, and rather than a simple planar surface the cathode is folded. Hollow cathode cavities are formed on both sides of a cylindrical body constituting the emitter using cup-shaped metal surfaces, with a small gap at the edge of the emitter. This configuration, for example, overcomes the above-mentioned performance limitations of the thermionic switch of the above-referenced application Ser. No. 430,579.

DETAILED DESCRIPTION OF THE INVENTION

The present invention is directed to an improved temperature responsive thermionic gas switch utilizing a hollow cathode and a folded emitter surface area. The folded emitter surface area of the thermionic switch substantially increases the "on/off" ratio by changing the conduction surface area involved in the two modes thereof. The improved switch of this invention provides an "on/off" ratio of 450:1 compared to 10:1 ratio of the prior known thermionic switch, while providing for adjusting the "on" current. In the improved switch of this invention the conduction area is made small in the "off" mode, while in the "on" mode the conduction area is made large. This is achieved by utilizing a folded hollow cathode configuration and utilizing a folded emitter surface area, and by making the dimensions of the folds small enough so that a space charge will develop in the convolutions of the folds and suppress unignited current, thus limiting the current carrying surface in the "off" mode. During the "on" mode, the state of ionization permits space charge neutralization in the convolutions of the emitter surface increasing the current carrying surface area.

Figure 1:
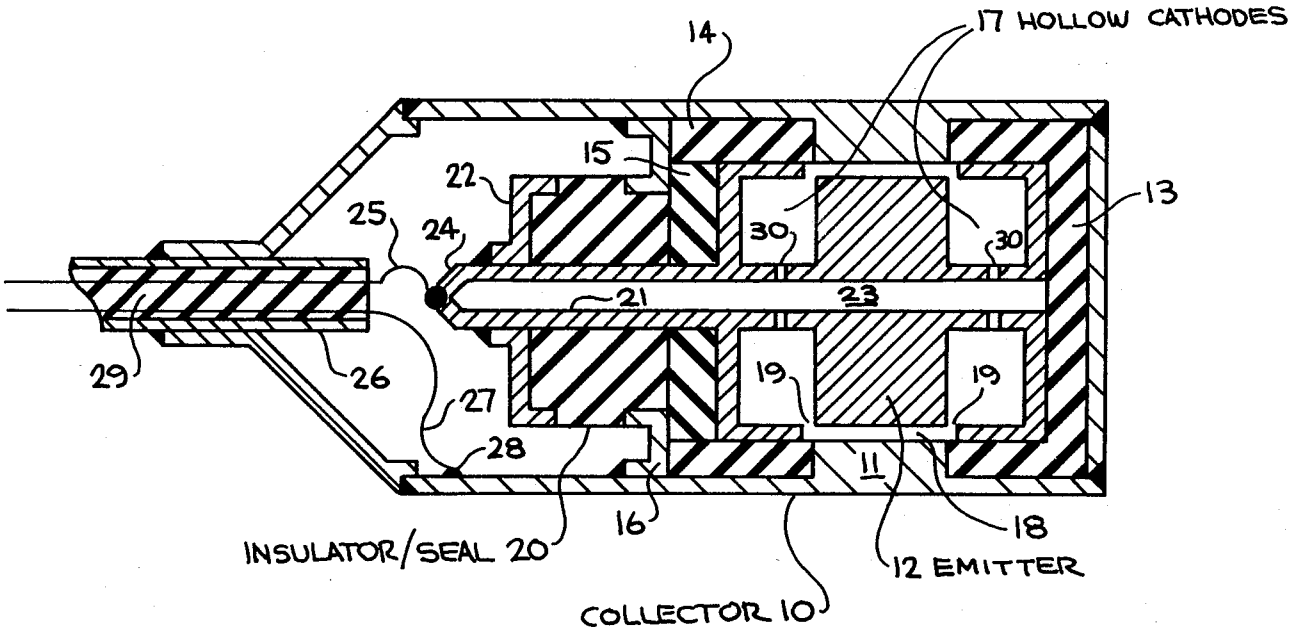
FIG. 1 illustrates in cross-section an embodiment of a thermionic gas switch made in accordance with the present invention.

FIG. 1 illustrates an embodiment of the hollow cathode, folded emitter surface area, thermionic gas switch of this invention. In this embodiment, the cathode is folded rather than utilizing a simple planar surface. Thus, hollow cathode cavities are formed on both sides of a cylindrical emitter body using cup-shaped metal surfaces.

Figure 2:
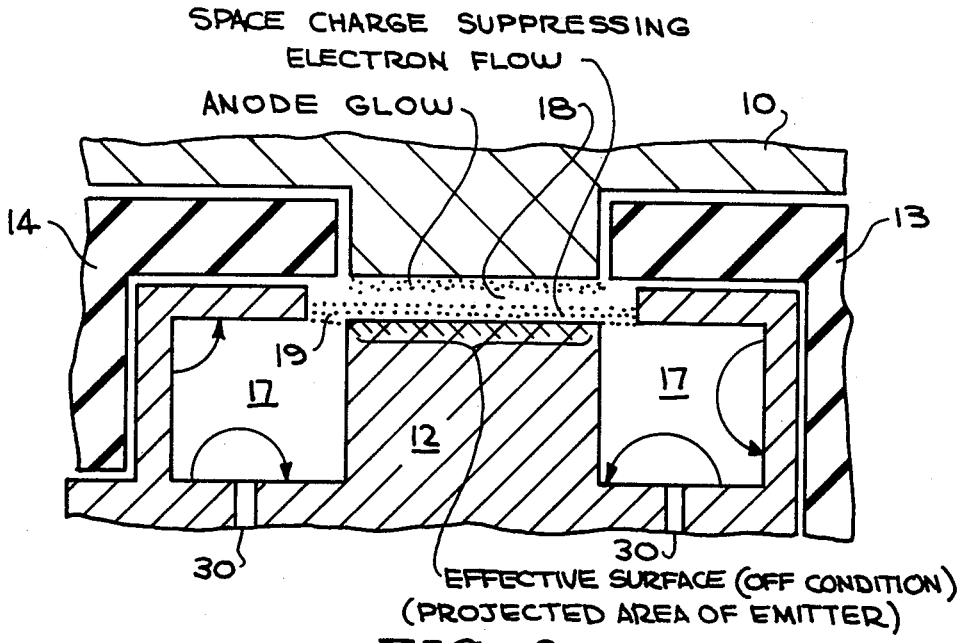
FIG. 2 illustrates the "off" surface configuration of the FIG. 1 switch.
Figure 3:
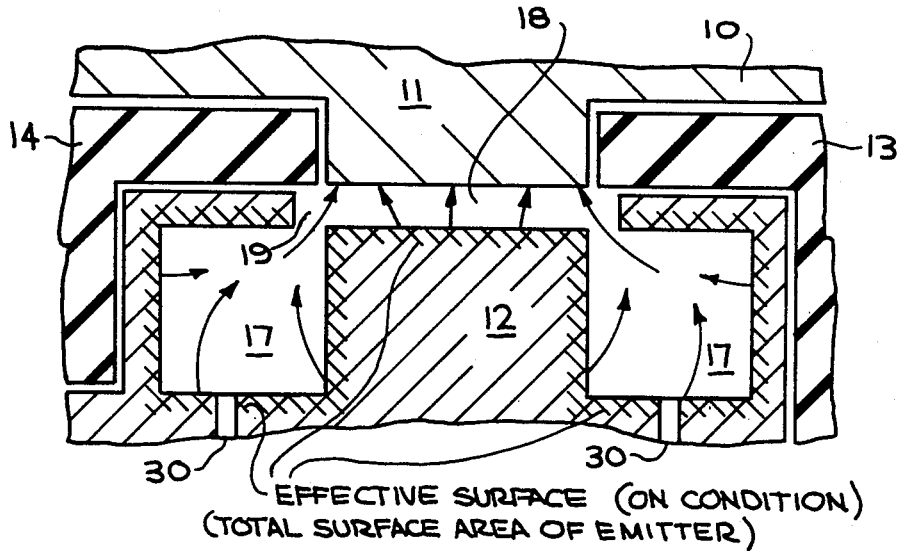
FIG. 3 illustrates the "on" surface configuration of the FIG. 1 switch.

More specifically the improved temperature responsive thermionic switch illustrated in FIG. 1 comprises a collector electrode 10 having an inwardly projecting section 11 and within which is located centrally therein an emitter electrode 12 electrically insulated from collector 10 by insulators 13, 14 and 15. An annular U-shaped member 16 is secured to collector 10 for retaining insulators 14 and 15 adjacent emitter 12. If desired, insulator members 14 and 15 can be formed as a single member as shown in FIGS. 2 and 3. Emitter 12 includes a cylindrical body section which is provided with a pair of spaced annular openings which constitute hollow cathodes 17, and provided with a reduced diameter or cut-away section which constitutes an interelectrode gap 18 between emitter electrode 12 and inwardly projecting section 11 of collector electrode 10, and additionally forms a pair of small cathode gaps 19 at each end of interelectrode gap 18. An insulator/seal member 20 is positioned around a projecting end section 21 of emitter 12 and in abutment with insulator 14. Insulator/-seal member 20 is retained by U-shaped member 16 secured to collector 10 and by an outwardly extending member 22 secured to projecting end section 21 of emitter 12. Emitter 12 additionally includes a central longitudinally extending opening or passageway 23 which extends through the body section and the end section 21 of emitter 12 and is closed at one end as indicated at 24. An electrical lead 25 is secured at closed end 24 and extends through a tubular member 26 secured to collector 10. An electrical lead 27 is secured at 28 to an inner surface of collector 10 and extends through member 26. Member 26 is filled with electrically insulative material 29. Leads 25 and 26 are adapted to be connected to an external apparatus (not shown) briefly described hereinafter. Emitter 12 is also provided with a plurality of openings or holes 30 which provide communication between cavities (hollow cathodes) 17 and passageway 23. While not shown, the cylindrical surface of emitter 12 may be convoluted with small grooves or indentations to further enhance performance. Cesium having a specified vapor pressure is established and retained in the hollow cathode and interelectrode gap as well as in opening 23 and holes 30.

By way of example, the collector 10 may be constructed of molybdenum or stainless steel and have a cylindrical length of 1 to 6 inches, a diameter of 0.5 to 2 inches, and a wall thickness of 0.04 to 0.25 inch, with the inwardly projecting section 11 having a length of 0.5 to 2.0 inches and a thickness of 0.1 to 0.25 inch. The emitter 12 may be constructed of molybdenum or tungsten with the cylindrical body section having a length of 1 to 6 inches and diameter of 0.25 to 2.0 inches, and with the projecting end section 21 having a length of 0.5 to 4 inches and diameter of 0.1 to 1 inch. The longitudinal extending central opening of emitter 12 may have a diameter of 0.1 to 0.75 inch. The spaced annular openings in emitter 12 which form the hollow cathodes 17 may have a width of 0.25 to 2 inches and depth of 0.1 to 1 inch, with the cut-away section constituting gap 18 having an outer diameter of 0.25 to 2 inches and length of 0.25 to 2 inches, such that the thickness of gap 18 is 0.02 to 0.05 and the thickness of each of gaps 19 is 0.02 to 0.05 inch. The insulators 13, 14 and 15 may be constructed of alumina or zirconia, with insulator/seal member 20 constructed of alumina or zirconia. The insulative material 29 may consist of alumina or beryllia with leads 25 and 26 composed of copper or nickel. The hollow cathodes 17 and gaps 18 and 19 may contain cesium vapor with a pressure of $10^{-3}$ to $10^{-1}$ Torr. If desired, for certain applications the cesium vapor may be replaced with barium vapor or cesium oxide vapor.

In the pre-switched (off) mode or condition of the FIG. 1 switch, the conducting surface is restricted to the lateral surface or outer surface of the reduced diameter section of emitter 12 (see FIG. 2) adjacent inwardly projecting section 11 of collector 10. The area of conduction is equal to the product of the circumference of the emitter times the length of the emitter. No conduction takes place in the hollow cathodes 17 because space charge buildup in its cavity suppresses electron conduction, as indicated by legend the "space charge suppressing electron flow" in FIG. 2. Also, the "anode glow" is illustrated in FIG. 2, as indicated by legend.

When switching occurs due to temperature increase (on mode), see FIG. 3, increase in the cesium ionization rapidly neutralizes the pre-switched space charge buildup in the interelectrode gap 18, cathode gaps 19 and cavities of cathodes 17 (as well as the emitter grooves or indentations if utilized). Thus, the complete interior of the hollow cathode cavities and the extended or unfolded surface of the emitter are involved in electron conduction, as indicated by legend in FIG. 3.

It is thus seen that the "effective surface" of the emitter in the "on" condition as shown in FIG. 3 is substantially greater than the "effective surface" of the emitter in the "off" condition as shown in FIG. 2. In this way the area ratio can be made very large and consequently enhance the "on/off" current ratio.

In operation, the thermionic gas switch is located so as to control a mechanism in response to a pre-set temperature condition. The switch functions to activate or deactivate an electrical control device, which in turn causes activation of the mechanism to be controlled, such as a door, window. fuel supply, reactor control rod, etc. For example, the collector lead 27 is connected to a positive terminal of a current source and the emitter lead 25 is connected to a negative terminal of the current source. During normal (operational) temperature conditions, flow of conventional positive current through the switch passes from the radial extending surface of the collector 10 across gap 18 to the radial extending surface of the emitter 12. During abnormal (non-operational) temperature conditions, the flow of conventional positive current through the switch passes from the radial extending surface of the collector 10 across gap 18 to the unfolded radial extending surface of the emitter 12 and across gaps 19 to the internal surfaces of the hollow cathodes 17.

It has thus been shown that the present invention provides an improved thermionic gas switch responsive to temperature which substantially increases the "on/-off" ratio over prior known switches of this type, and thus has overcome the disadvantages or limitations of these prior known switches. This is accomplished by utilizing a folded emitter arrangement which has a small conductive area in the "off" mode, but a relatively large conductive area in the "on" mode.

While a particular embodiment of the invention has been illustrated and described, modifications, such as utilizing additional pairs of interconnected cathode cavities, etc., will become apparent to those skilled in the art, and it is intended to cover in the appended claims, all such modifications as come with the spirit of this invention.

We claim:

1. In a thermionic switch responsive to temperature and including an emitter electrode, a collector electrode positioned around the emitter electrode, means for electrically insulating the emitter electrode from the collector electrode, and a quantity of thermionic material located within the collector electrode, the improvement comprising: said emitter electrode being constructed so as to have a plurality of surfaces, said surfaces being positioned with respect to said collector electrode such that during an "off" mode thereof only a portion of the surface of the emitter electrode is effective, and during an "on" mode all of the surfaces of the emitter electrode are effective.

2. The improvement of claim 1, wherein said emitter electrode is constructed so as to have a body section with a plurality of spaced annular cavities interconnected by a gap located about a reduced cross-section external area of said body section, said plurality of surfaces of said emitter electrode being located on the surface area of each of said plurality of cavities and on the surface area adjacent said gap.

3. The improvement of claim 2, wherein said switch is of the hollow cathode type, the hollow cathodes being formed by said annular cavities in said emitter electrode, and wherein said thermionic material is located in said plurality of cavities and in said gap interconnecting said cavities.

4. A temperature responsive thermionic gas switch of a hollow cathode type capable of substantially increasing the "on/off" current ratio and adjusting the "on" current by employing a folded emitter surface, said switch comprising:

a collector at least partially forming a casing within which an emitter is positioned with electrical insulation means located intermediate said collector and said emitter;

electrical lead means connected to said collector and said emitter and extending from said casing;

said collector having at least one inwardly projecting section;

said emitter having at least a body section including at least one reduced cross-sectional portion located in spaced relation to said inwardly projecting section of said collector, said emitter additionally including a plurality of spaced annular cavities located within said body section on opposite sides of said reduced cross-sectional portion, said annular cavities being interconnected by gaps formed between said annular cavities and said reduced cross-sectional portion and a gap formed between said reduced cross-sectional portion of said emitter and said inwardly projecting section of said collector; and thermionic material located within said annular openings and said interconnecting gaps.

5. The thermionic gas switch of claim 4, wherein said emitter additionally includes a projecting end section, one of said electrical lead means being connected to said projecting end section.

6. The thermionic gas switch of claim 5, wherein said emitter additionally includes a centrally located, longitudinal opening that extends through at least a portion of said body section and said end section and is closed at an outer end of said end section.

7. The thermionic gas switch of claim 5, wherein said insulation means includes a first insulation member located around one end of said body section of said emitter and between said emitter and said collector, and at least a second insulation member located around an opposite end of said body section of said emtter and between said emitter and said collector.

8. The thermionic gas switch of claim 5, additionally including an insulator/seal member positioned around at least a portion of said projecting end section of said emitter, and means for retaining said insulator/seal member about said end section of said emitter.

9. The thermionic gas switch of claim 8, wherein said retaining means includes a first member secured to said collector, and a second member spaced from said first member and secured to said projecting end section of said emitter, said first member additionally retaining said second insulation member around said opposite end of said body section of said emitter.

10. The thermionic gas switch of claim 5, wherein said collector and said emitter are cylindrical in configuration, said collector being closed at one end and connected at an opposite end to a tubular member through which said electrical lead means extend, said tubular member containing insulative material.

11. In a thermionic gas switch responsive to temperature having a collector, an emitter, electrical insulation between the collector and the emitter, electrical lead lines for the emitter and the collector, and a quantity of thermionic material, the improvement comprising:

a cylindrically configured collector forming an outer casing of said switch, said collector being closed at one end and connected at an opposite end to a tubular member, said collector including at least one inwardly projecting annular section; and a cylindrically configured emitter located within said casing formed by said collector and including a body section and a projecting end section, said body section of said emitter including at least one reduced diameter section, said body section of said emitter additionally including at least a pair of annular cavities located within said body section, said pair of cavities being located on opposite sides of said reduced diameter section, means forming an interconnecting gap between said pair of cavities and extending between said reduced diameter section of said emitter and said inwardly projecting section of said collector.

12. The improvement of claim 11, wherein the electrical insulation between the collector and the emitter comprises:

insulator material positioned around one end of said body section of said emitter and between said emitter and said collector, and insulator material positioned around an opposite end of said body section of said emitter and between said emitter and said collector.

13. The improvement of claim 11, additionally including an insulator/seal positioned around said projecting end section of said emitter, and means for retaining said insulator/seal positioned in abutment with said insulator material positioned around said opposite end of said body section of said emitter.

14. The improvement of claim 11, wherein the electrical lead lines for the emitter and collector consist of a first lead line that extends through said tubular member and secured to said projecting end section of said emitter, and a second lead line that extends through said tubular member and secured to an inner surface of said cylindrically configured collector.

15. The improvement of claim 14, wherein said tubular member is filled with insulative material.

16. The improvement of claim 11, wherein the thermionic material consists of cesium vapor retained in said pair of cavities and said interconnecting gap of said emitter.

17. The improvement of claim 11, wherein said emitter additionally includes a longitudinally extending opening in at least a portion of said body section and in at least a portion of said projecting end section thereof, and a plurality of passages interconnecting said longitudinally extending opening with said plurality of spaced annular cavities of said body section.

18. The improvement of claim 17, wherein the thermionic material is retained in said longitudinally extending opening, said passages, said annular cavities, and said interconnecting gap of said emitter.

19. The improvement of claim 13, wherein said means for retaining said insulator/seal includes:

a first member secured to said collector, and a second member spaced from said first member and secured to said projecting end section of said emitter, said first member additionally retaining said insulator material positioned around said opposite end section of said emitter.

20. The improvement of claim 19, wherein said insulator material positioned around said opposite end section of said emitter comprises:

a first insulator member located between said emitter and said collector, and a second insulator member located between said emitter and said insulator/seal.

* * * * *